US005586034A

United States Patent [19]

Takaba et al.

[11] Patent Number: 5,586,034

[45] Date of Patent: Dec. 17, 1996

[54] DATA COMMUNICATION EQUIPMENT FOR TRANSFERRING DATA

[75] Inventors: Katsumi Takaba, Oobu; Satoshi Ishii, Toyota, both of Japan

[73] Assignees: Nippondenso Co., Ltd., Kariya; Toyota Jidosha Kabushiki Kaisha, Toyota, both of Japan

[21] Appl. No.: 605,263

[22] Filed: Jan. 19, 1996

Related U.S. Application Data

[63] Continuation of Ser. No. 191,497, Feb. 4, 1994, abandoned.

[30] Foreign Application Priority Data

Feb. 9, 1993 [JP] Japan ..... 5-021290

[51] Int. Cl.[6] ..... G06G 7/70

[52] U.S. Cl. ..... 364/431.04; 364/431.11; 364/431.12; 364/424.034; 73/118.1; 73/117.3; 123/339.1; 123/361

[58] Field of Search ..... 364/431.04, 431.11, 364/431.12, 424.01, 424.03, 424.04, 550, 431.06, 431.01, 551.01; 73/118.1, 117.3; 340/438, 439, 825.02, 825.05, 825.06, 825.51, 436; 395/312, 250, 880, 294; 123/361, 416, 417, 425, 339

[56] References Cited

U.S. PATENT DOCUMENTS

| | | | |
|---|---|---|---|
| 4,174,536 | 11/1979 | Misunas et al. | 395/325 |
| 4,257,099 | 3/1981 | Appelt | 395/325 |
| 4,271,465 | 6/1981 | Ohtsuka et al. | 395/325 |
| 4,527,271 | 7/1985 | Hallee et al. | 364/186 |
| 4,556,943 | 12/1985 | Pauwels et al. | 364/431.12 |
| 4,894,781 | 1/1990 | Sato et al. | 364/431.04 |
| 4,943,924 | 7/1990 | Kanegae et al. | 364/431.12 |
| 4,945,486 | 7/1990 | Nitschke et al. | 364/431.12 |
| 4,992,950 | 2/1991 | Fancisco | 364/132 |
| 5,001,642 | 3/1991 | Botzenhardt et al. | 364/431.12 |
| 5,003,485 | 3/1991 | Francisco | 364/132 |
| 5,142,474 | 8/1992 | Miyata et al. | 364/431.11 |
| 5,182,798 | 1/1993 | Francisco | 395/325 |
| 5,293,317 | 3/1994 | Adrian et al. | 364/431.12 |
| 5,303,348 | 4/1994 | Botzenhardt et al. | 364/431.04 |
| 5,369,581 | 11/1994 | Ohsuga et al. | 364/431.04 |
| 5,369,584 | 11/1994 | Kajiwara | 364/431.11 |

FOREIGN PATENT DOCUMENTS

| | | |
|---|---|---|
| 8904784 | 6/1989 | Germany . |
| 1055605 | 3/1989 | Japan . |
| 2-62601 | 3/1990 | Japan . |
| 3-501178 | 3/1991 | Japan . |
| 3-115761 | 5/1991 | Japan . |

*Primary Examiner*—Gary Chin
*Assistant Examiner*—Jacques Louis-Jacques
*Attorney, Agent, or Firm*—Cushman, Darby & Cushman; IP Group of Piilsbury Madison & Sutro LLP

[57] ABSTRACT

Data communication equipment which includes a plurality of CPUs and transfers data between these CPUs, and which simplifies the circuit construction necessary for the data transfer. A monitor device transfers a request data containing a CPU number (corresponding to CPUN 1) storing a desired trouble data and an address (corresponding to ADR 1) storing the trouble data, to a second CPU. The requested data is sequentially transferred to the first CPU and the third CPU, and the CPU designated by CPUN 1 transfers the trouble data (DATAO 1, DATAO 3) and the address (ADRO 1, ADRO 3) storing the trouble data, to the monitor device. For this reason, each CPU need not be connected individually to the monitor device 43.

8 Claims, 6 Drawing Sheets

REQUEST FORMAT

RESPONSE FORMAT

DATA COMMUNICATION EQUIPMENT FOR TRANSFERRING DATA

This is a continuation of application Ser. No. 08/191,497, filed on Feb. 4, 1994 now abandoned.

BACKGROUND OF THE INVENTION

1. Field of the Invention

This invention relates to data communication equipment which serves a plurality of central processing units (CPUs) and which transfers data between these CPUs.

2. Description of the Related Art

Japanese Unexamined Patent Publication (Kokai) No. 3-501178, for example, describes data communication equipment which serves a plurality of central processing units in one control system, and transfers data between the CPUs. In the data communication equipment of this kind, data can be transferred mutually while the CPUs execute, in parallel, mutually different processes, and the data processing speed of the control system can be improved as a whole.

When such data communication equipment is applied to a trouble shooting apparatus for automobiles as described, for example, in Japanese Unexamined Patent Publication (Kokai) No. 64-55605, it may be possible to individually connect each CPU to a monitor device for trouble diagnosis by connecting each CPU to each of various sensors so as to detect any trouble. When a predetermined sensor is designated by the monitor device according to this arrangement, the CPU connected to this sensor can instantaneously read any trouble at this sensor.

In the data communication equipment of this kind, however, signal lines and input/output ports must be provided in data paths for transferring the data between the CPUs and for each direction of the data transfer. In the case of the trouble shooting apparatus described above, for example, the same number of input/output ports as the number of the CPUs must be provided to the monitor device, and each CPU and its input/output port must be individually connected by a pair of signal lines. For this reason, the circuit construction of the apparatus becomes unavoidably complicated.

SUMMARY OF THE INVENTION

Accordingly, the present invention is directed to simplifying the construction of a circuit required for data transfer in a data communication equipment which serves a plurality of CPUs and which transfers data between these CPUs.

To accomplish the object described above, the present invention provides data communication equipment which serves a plurality of central processing units sequentially and electrically connected with one another, and an output device for outputting data containing a designation code for designating a predetermined one of the CPUs to another specific CPU, wherein each of the central processing units processes data containing the designation code designating the central processing unit itself when the data is input from the output device or from the central processing unit adjacent thereto, but transfers the data containing the designation code designating another of the central processing units, to a next one of the central processing units without processing the data.

According to the present invention having the construction described above, the output device outputs the data containing the designation code which designates a predetermined one of a plurality of central processing units, to the specific central processing unit. Each CPU is connected sequentially and electrically, and when the data output by the output device is input either directly from the output device or from the adjacent CPU, the CPU processes the data in the following way.

In other words, the CPU processes the data containing the designation code designating itself but transfers the data containing the designation code designating another CPU, to the next CPU without processing it.

Accordingly, in the present invention, the data output by the output device is sequentially transferred to each CPU, and a designated CPU can process desired data. In consequence, each CPU and the output device need not be connected individually and electrically, and the circuit construction necessary for the data transfer can be simplified.

DESCRIPTION OF THE PREFERRED EMBODIMENTS

Preferred embodiments of the present invention will be explained with reference to the accompanying drawings.

Figure 1:
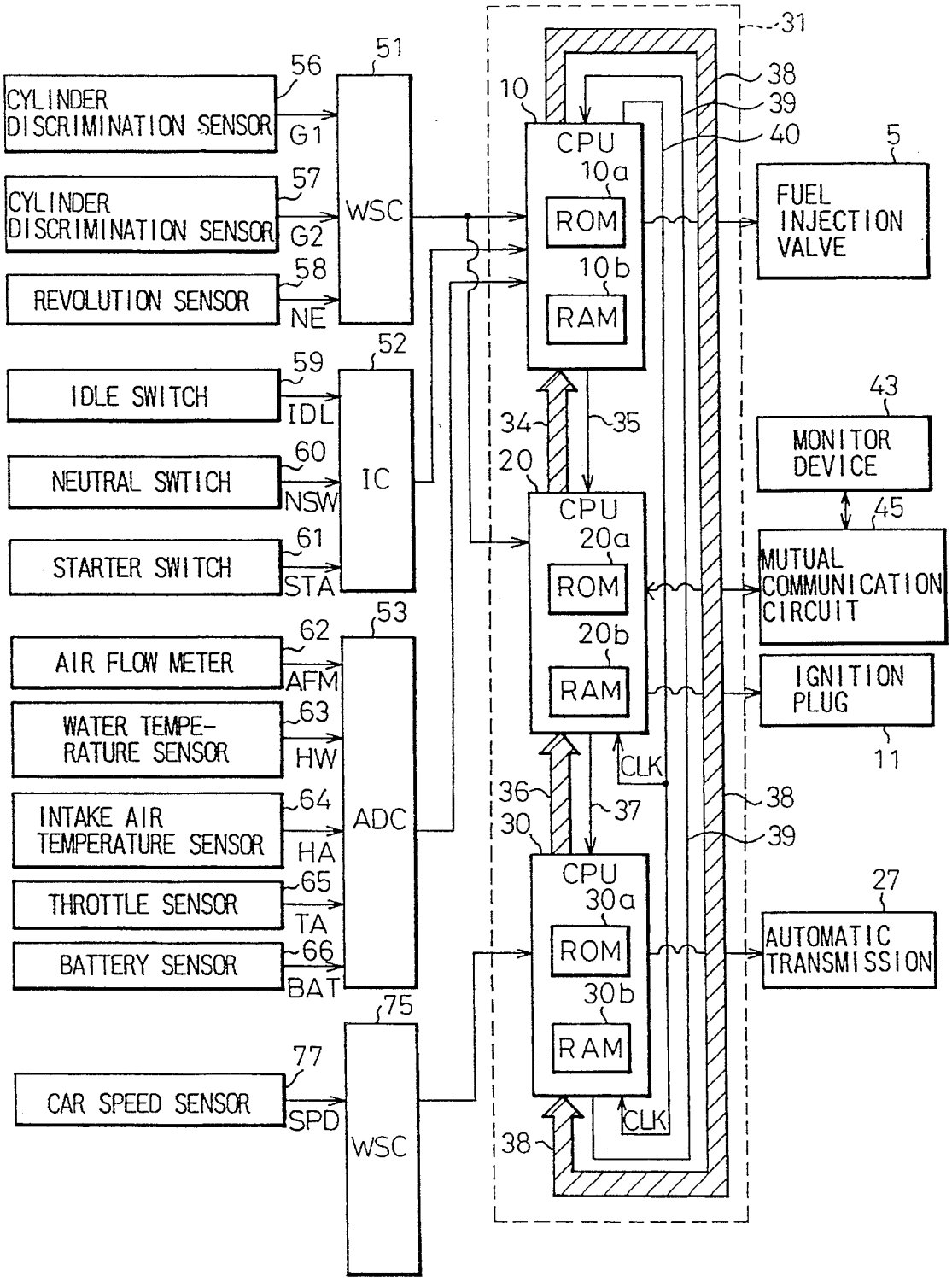
FIG. 1 is a block diagram showing the construction of a trouble shooting apparatus for automobiles according to an embodiment of the present invention.

FIG. 1 is a block diagram explaining a trouble shooting apparatus for automobiles according to an embodiment of the present invention. The trouble shooting apparatus according to this embodiment serves one control system including inside one electronic control unit (ECU) 31, a first central processing unit (hereinafter referred to as a "first CPU") 10 for controlling a fuel injection valve 5 for injecting a fuel into each cylinder of an engine, a second CPU 20 for controlling an ignition plug 11 for igniting each cylinder and a third CPU 30 for controlling an automatic transmission 27 for automatically switching transmission gears.

The CPUs 10 to 30 are electrically and sequentially connected with one another. Namely, the first and second CPUs 10, 20 are connected by a data line 34 for transferring data obtained by the second CPU 20 to the first CPU 10, and by a transmission permission signal line 35 which reports to the second CPU 20 that the first CPU 10 can receive data. Similarly, the second and third CPUs 20, 30 are connected by a data line 36 for transferring the data obtained by the third CPU 30 to the second CPU 20 and by a transmission permission signal line 37. Further, the first and third CPUs 10, 30 are likewise connected by a data line 38 for transferring the data from the first CPU 10 to the third CPU 30 and by a transmission permission signal line 39. A sync (synchronization) signal line 40 is connected to each of these CPUs 10 to 30 so as to establish synchronization between them, and the first CPU 10 inputs a clock signal CLK to the second and third CPUs 20, 30 through this sync signal line 40. A monitor device 43 for displaying the position of a trouble, etc, is connected to the second CPU 20 through a mutual communication circuit 45.

The first CPU 10 is provided with a read-only memory (hereinafter referred to as a "ROM") 10*a* for storing various arithmetic programs executed by this first CPU 10, various tables used for computing a fuel injection quantity (a valve open time of the fuel injection valve 5), etc, and with a random access memory (hereinafter referred to as a "RAM") 10*b* for temporarily storing the result of the arithmetic operation.

Similarly, the second CPU 20 is provided with a ROM 20*a* for storing various arithmetic programs including a requested data reception processing for the monitor 43, and with a RAM 20*b* for temporarily storing the result of the arithmetic operation. Further, the third CPU 30 is provided with a ROM 30*a* for storing various arithmetic programs and speed change patterns of an automatic transmission 27, and with a RAM 30*b* for temporarily storing the result of the arithmetic operation.

A waveform shaping circuit 51, an input circuit 52 and an analog-to-digital converter (hereinafter referred to as an "A/D converter") 53 are connected to the input side of the first CPU 10. Cylinder discrimination signals G1 and G2 which are alternately generated by a pair of cylinder discrimination sensors 56, 57 whenever the engine crank shaft revolves by 360° CA (CRANK ANGLE), and a revolution signal NE which is generated by a revolution sensor 58 in accordance with the number of revolution of the engine, are input to the waveform shaping circuit 51. An idle signal IDL, which is output by an idle switch 59 when a throttle valve, not shown in the drawing, is in a closed state, a neutral signal NSW, which is output by a neutral switch 60 when a shift lever, not shown, is in a neutral position, and a starter signal STA, which is output by a starter switch 61 at the start of the operation of the engine, are input to the input circuit 52. An air-flow signal AFM which is output by an air flow meter 62 in accordance with an intake air quantity of the engine, a cooling water temperature signal THW, which is output by a water temperature sensor 63 in accordance with the temperature of cooling water of the engine, an intake air temperature signal THA, which is output by an intake air temperature sensor 64 in accordance with the temperature of the intake air, a throttle opening signal TA, which is output by a throttle sensor 65 in accordance with the opening of the throttle valve, and a battery voltage signal BTA which is output by a battery voltage sensor 66 in accordance with a battery voltage, are input to the input side of the A/D converter 53.

A waveform shaping circuit 51 is connected to the input side of the second CPU 20 in the same way as in the first CPU 10. As already described, the second CPU 20 is connected to the monitor 43 through the mutual communication circuit 45, and bidirectional data communication is possible between the second CPU 20 and the monitor 43. In other words, when the data is output from either one of the monitor 43 and the second CPU 20, the mutual communication circuit 45 once stores the data, and outputs the data when the other (the second CPU 20 or the monitor 43) enters the data receivable state. In this way, bidirectional data communication becomes possible between the monitor 43 and the second CPU 20.

A waveform shaping circuit 75 is connected to the input side of the third CPU 30, and a car speed signal SPD generated by a car speed sensor 77 in accordance with a car speed is input to the input side of this waveform shaping circuit 75.

Next, examples of the data transferred by the communication between these CPUs 10 to 30 will be given.

Data necessary for the arithmetic operation during the speed change period and data necessary for the car speed sensor 77 to detect the trouble, such as the air flow signal AFM, a load quantity data QN representing the magnitude of a load calculated on the basis of the air flow signal AFM and the revolution signal NE, etc, the cooling water temperature data THW, the intake air temperature data THA, the throttle opening data TA, the battery voltage data BAT, and so forth, are transferred from the first CPU 10 to the third CPU 30.

Data necessary for detecting the trouble in the ignition system and data necessary for computing the ignition timing such as the car speed data SPD, the load quantity data QN, the cooling water temperature data THW, the intake air temperature data THA and the battery voltage data BAT are among those data which are transferred from the first CPU 10 to the third CPU 30, and transferred from the third CPU 30 to the second CPU 20.

Data necessary for determining the fuel injection quantity and the fuel injection timing, such as the car speed data SPD are among those data transferred from the third CPU 30 to the second CPU 20, are transferred from the second CPU 20 to the first CPU 10.

The CPUs 10 to 30 control the fuel injection valve 5, the ignition plug 11 and the automatic transmission 27 by known methods on the basis of the data transferred thereto, respectively. Further, they detect any trouble of various sensors and various systems such as the ignition system on the basis of the data transferred thereto. When the number of revolutions of the engine is within a predetermined range, for example, the cooling water temperature, too, is within a predetermined range. Accordingly, when the revolution signal NE is within a predetermined range, the first CPU 10 judges whether or not the cooling water temperature signal THW is within a predetermined range and thus detects any trouble of the water temperature sensor 63. These detection results are stored as trouble data 207 (see FIG. 2B) in predetermined addresses of these CPUs 10 to 30. When the monitor device 43 indicates the trouble diagnosis of various sensors, the following data are transferred between the monitor device 43 and each CPU 10 to 30.

Figure 2A:
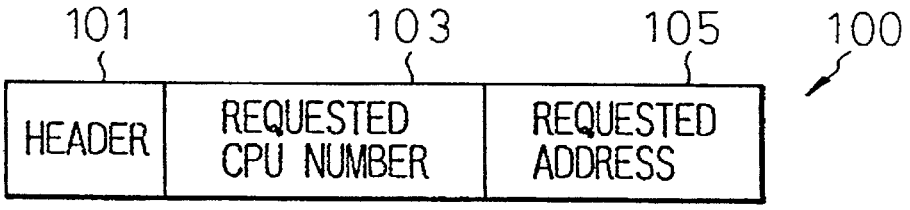
FIG. 2A and FIG. 2B are explanatory views showing the formats of data transferred between a second CPU and a monitor device.

When an operator requests diagnosis of a desired sensor, etc, at the monitor device 43, the monitor device 43 transfers request data 100 having a required format, which is typically illustrated in FIG. 2A, to the second CPU 20 through the mutual communication circuit 45. As shown in FIG. 2A, this request data 100 includes a header 101 representing the start of the data, a CPU number 103 representing any one of the CPUs (10 to 30) for detecting the trouble of the sensor, and an address 105 for indicating the address which stores the trouble data 207 (see FIG. 2B) of the sensor in the CPUs 10 to 30. Here, the monitor device 43 corresponds to an output device and the CPU number 103 corresponds to the designated code.

Figure 3:
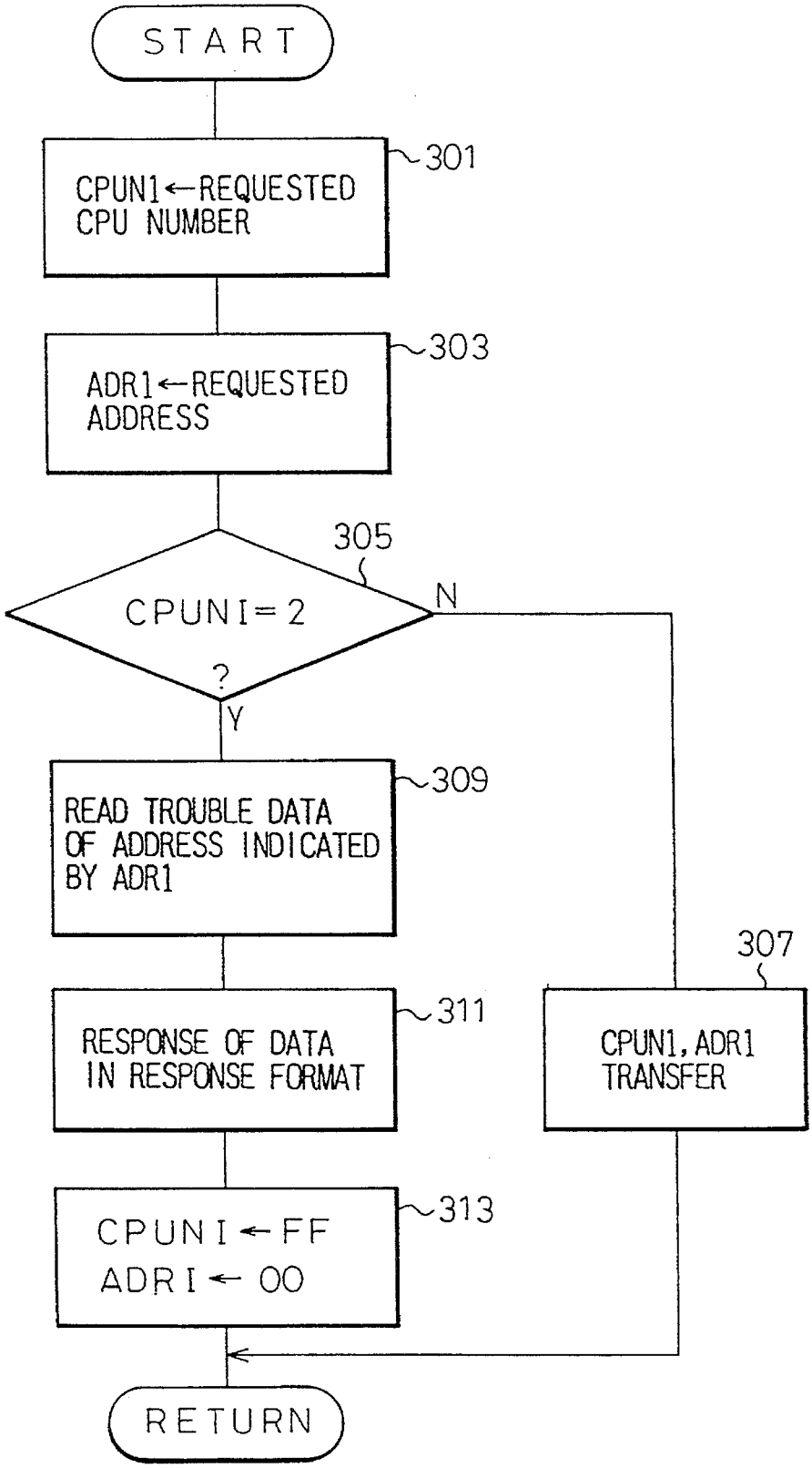
FIG. 3 is a flowchart representing requested data reception processing which is executed by the second CPU.

Receiving this request data 100, the second CPU 20 executes the request data reception process shown in the flowchart of FIG. 3.

When the processing is started, the number of the CPU 10 to 30 designated by the requested CPU number 103 is first set to the memory CPUN 1 at the step 301. When the first CPU 10 is designated, for example, CPUN 1=1. At the next step 303, the address designated by the requested address 105 is set to the memory ADR 1.

Subsequently, whether or not CPUN 1=2 is judged at the step 305. When CPUN 1≠2, this means the state where the sensor, etc, the trouble of which is detected by the other CPU 10 to 30, is designated by the monitor 43. In this case, the flow proceeds to the step 307, where the contents of the memories CPUN 1 and ADR 1 are transferred to the memories CPUN 1, ADR 1 of the first CPU 10, and the processing is completed.

Figure 2B:
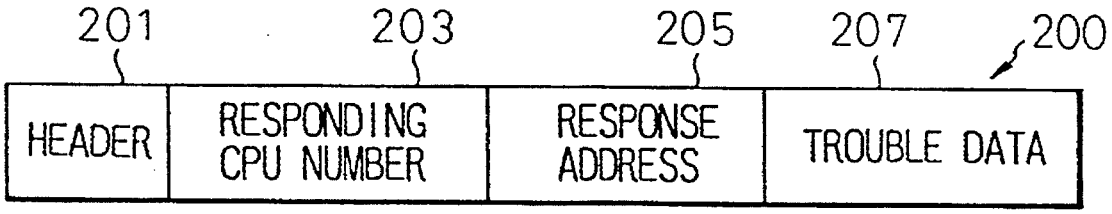

When the judgement proves YES at the step 305, on the other hand, this means that the sensor, etc, the trouble of which is detected by the second CPU 20 itself, is designated by the monitor 43. In this case, the flow proceeds to the step 309, and the trouble data (see FIG. 2) stored in the address designated by the memory ADR 1 is read out. At the next step 311, the response data 200 having the form of the response format typically shown in FIG. 2B is generated, and is transferred to the monitor 43 through the mutual communication circuit 45.

Here, the response data 200 sequentially comprises the header 201 representing the start of the data, the responding CPU number 203 designating the CPU 10 to 30 detecting the trouble of the sensor, etc, the response address 205 designating the address at which the trouble data 207 of the sensor by the CPU 10 to 30 are stored, and the trouble data 207 read out from this address. Receiving this response data 200, the monitor device 43 executes known processes such as the display of the trouble condition of the sensor, etc. At the subsequent step 313, the memories CPUN 1 and ADR 1 are initialized to $FF_{(16)}$ and $00_{(16)}$, respectively, and the processing is completed.

Figure 4:
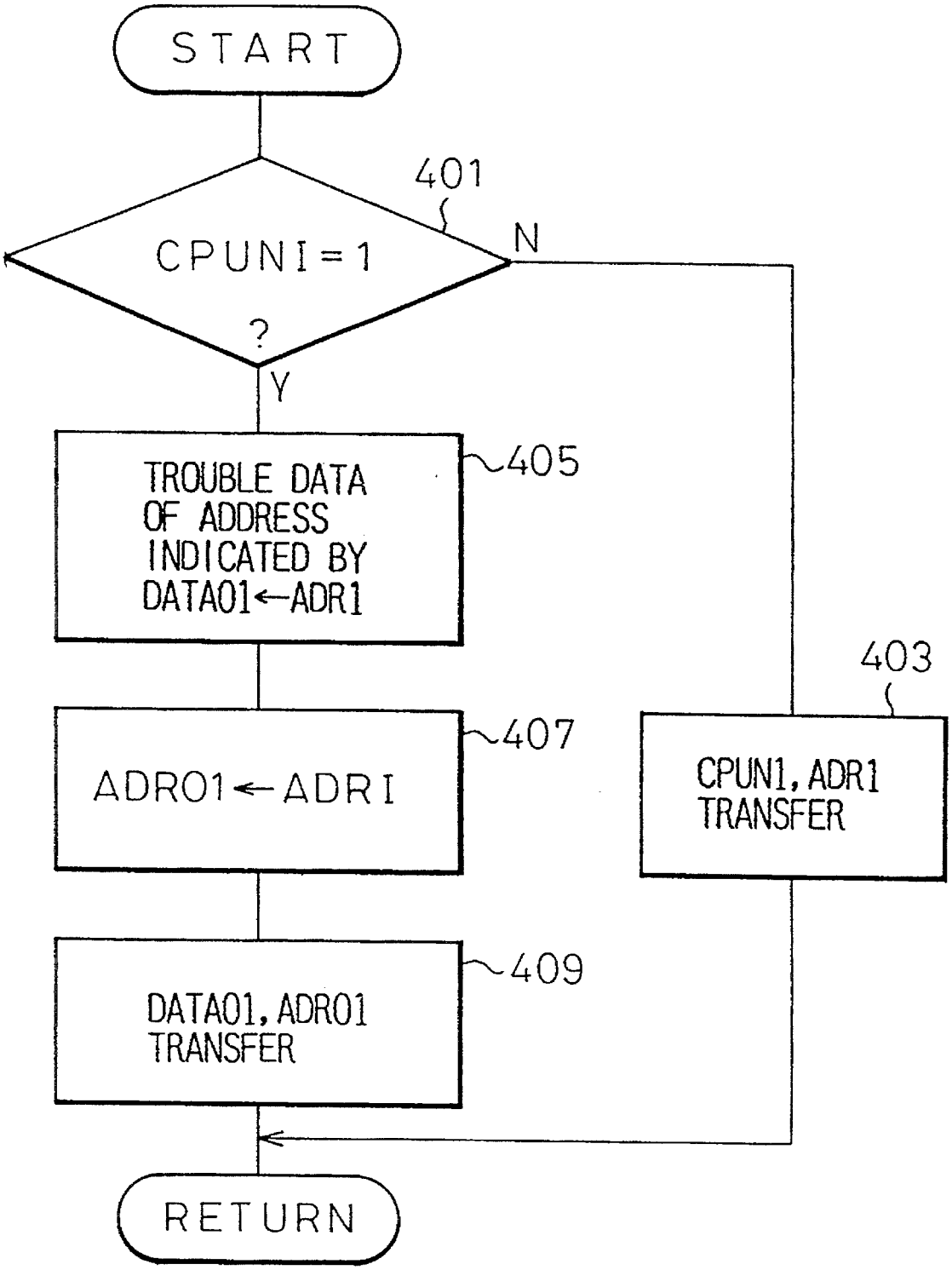
FIG. 4 is a flowchart representing memory transfer processing which is executed by a first CPU.

When the contents of the memories CPUN 1 and ADR 1 are transferred to the first CPU 10 at the step 307, the first CPU 10 executes the memory transfer process shown in the flowchart of FIG. 4.

When the process is started, whether or not CPUN 1=1 is first judged at the step 401. When CPUN 1≠1, the flow proceeds to the step 403, where the contents of the memories CPUN 1 and ADR 1 are transferred to the third CPU 30, and the processing is completed.

On the other hand, when the result of judgement proves YES at the step 401, this means that the sensor the trouble of which is detected by the first CPU 10 itself is designated, and the flow then proceeds to the step 405. At this step 405, the trouble data 207 corresponding to the memory ADR 1 is read out, and the content of this trouble data 207 is set to the memory DATAO 1. At the step 407, the value of the memory ADR 1 is set to the memory ADRO 1, and the flow then proceeds to the step 409. At this step 409, the contents of the memories DATAO 1 and ADRO 1 that have been set at the steps 405 and 407 are transferred to the third CPU 30 by the serial DMA, and the processing is completed.

When the contents of the memories DATAO 1 and ADRO 1 are transferred at the step 409, the third CPU 30 becomes irrelevant and has nothing to do any more. Therefore, the contents of the memories DATAO 1 and ADRO 1 are as such transferred to the second CPU 20. When the contents of the memories CPUN 1 and ADR 1 are transferred at the step 403, processing similar to that of FIG. 4 such as confirmation of the designated code is executed, with the proviso that the destination of transfer in this case is the second CPU 20.

Subsequently, when the contents of the memories DATAO 1 and ADRO 1 or DATAO 3 and ADRO 3 (which are set by the third CPU 30 in the same way as the memories DATAO 1 and ADRO 1) are transferred from the third CPU 30, the second CPU 20 executes the response data transfer process shown in the flowchart of FIG. 5.

When the process is started, whether or not the memory CPUN 1 set at the step 301 in FIG. 3 is 2 is judged at the step 501. When CPUN 1=2, judgment is made to the effect that any abnormality occurs in the processing of the memory CPUN 1, and the processing is as such completed. When CPUN≠2, whether or not CPUN 1=1 is judged at the next step 503. If the result of judgement proves YES at the step 503, the flow proceeds to the subsequent step 505, and whether or not the content of the memory ADR 1 set on the basis of the requested address 105 at the step 303 coincides with the content of the memory ADRO 1 set by the first CPU 10 at the step 407 in FIG. 4 is judged.

When ADR 1=ADRO 1 (YES at the step 505), the trouble data 207 requested by the monitor 43 is judged as being correctly transferred, and the flow proceeds to the step 507. At this step 507, the response data 200 is generated by regarding the contents of the memories CPUN 1, ADRO 1, DATAO 1 as the response CPU number 203, the response address 205 and the trouble data 207, respectively, and is transferred to the monitor 43 through the mutual communication circuit 45. Further, at the subsequent step 509, the memories CPUN 1 and ADR 1 are initialized to $FF_{(16)}$ and $00_{(16)}$, respectively, and the processing is completed.

When ADR 1 ADRO 1 (NO at the step 505) irrespective of the relation CPUN 1=1 (YES at the step 503), the trouble data 207 requested by the monitor 43 for the first CPU 10 is judged as not being correctly transferred, and the processing is as such completed.

On the other hand, when the judgement result is CPUN 1 1 at the step 503, the flow proceeds to the step 511, and whether or not CPUN 1=3 is judged. When CPUN 1=3, whether or not ADR 1=ADRO 3 is judged at 10 the subsequent step 513. If the result of judgement is YES, the trouble data 207 requested by the monitor 43 is judged as being correctly transferred, and the flow proceeds to the processings of the step 507 et seq. When the result of judgement proves NO, the processing is as such completed.

Further, when the result of judgement is NO at all the steps 501, 503 and 511, this means that the value of the memory CPUN 1 is not any of 1 to 3. In this case, the processing is as such completed by regarding that readout of the requested CPU number 103 is not correctly effected.

Figure 5:
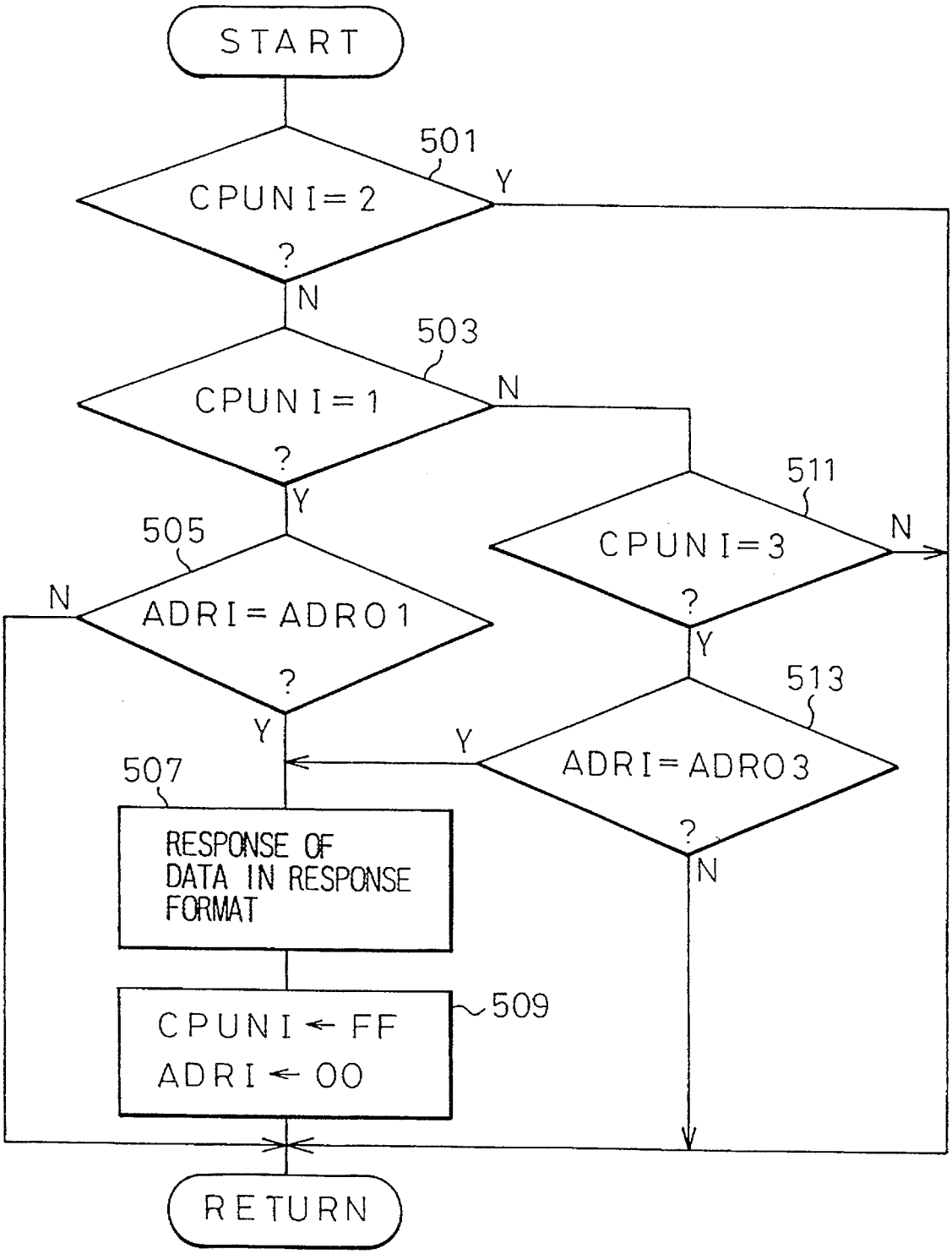
FIG. 5 is a flowchart representing response data transfer processing which is executed by the second CPU.
Figure 6:
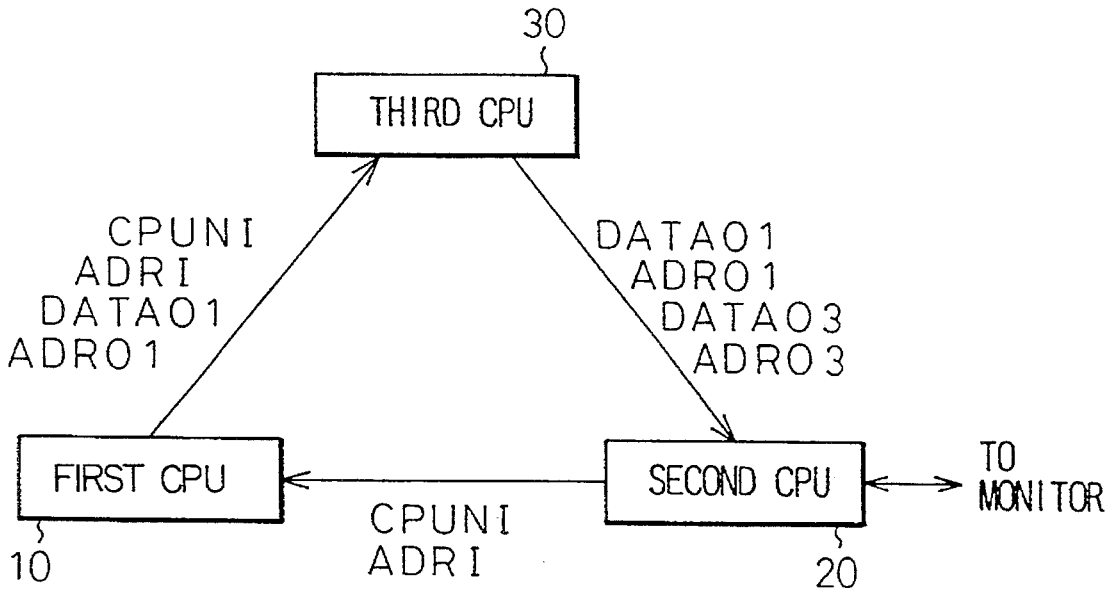
FIG. 6 is a block diagram showing the flow of data transferred between the CPUs.

FIG. 6 is a block diagram showing the flows of the data transferred between the CPUs 10 to 30 by the processes shown in FIGS. 3 to 5. When the requested CPU number 103 of the requested data 100 does not indicate the second CPU 20, the contents of the memories CPUN 1 and ADR 1 storing the requested CPU number 103 of the requested data 100 and the requested address 105 are transferred from the second CPU 20 to the first CPU 10. When the requested CPU number 103 does not indicate the first CPU 10, the contents of the memories CPUN 1 and ADR 1 are similarly transferred from the first CPU 10 to the third CPU 30.

On the other hand, when the requested CPU number 103 indicates the first CPU 10, the contents of the memories ADRO 1 and DATAO 1 storing the contents corresponding to the response address 205 of the response data 200 and to the trouble data 207 are transferred from the first CPU 10 to the second CPU 20 through the third CPU 30. Similarly, when the requested CPU number 103 indicates the third CPU 30, the contents of the memories ADRO 3 and DATAO 3 corresponding to the response address 205 and to the trouble data 207 are transferred from the third CPU 30 to the second CPU 20.

The second CPU 20 transfers the response data 200 corresponding to the requested data 100 to the monitor 43 on the basis of the data transferred in the way described above.

As described above, the trouble shooting apparatus for automobiles according to this embodiment transfers the requested data 100 output by the monitor 43 in the sequence of the second CPU 20, the first CPU 10, and the third CPU 30 through the memories CPUN 1 and ADR 1. In this way, it becomes possible to request a desired data 207 from any desired CPU (10 to 30) corresponding to the request CPU number 103. Accordingly, a trouble shooting circuit can be constituted by merely connecting the monitor 43 to one of the CPUs (the second CPU 20 in this embodiment) by utilizing the existing data lines 34 to 38. In comparison with the case where the data lines 34 to 38 have not yet been extended, it is not necessary to individually connect the CPUs 10 to 30 to the monitor 43 through the three mutual communication circuits 45. For this reason, this embodiment can simplify the circuit construction by using the trouble shooting apparatus.

It is further possible to utilize the go-and-return path of the original path, that is, the line of the third CPU 30→the first CPU 10→the second CPU 20, in place of the line of the third CPU 30 to the second CPU 20.

Although the embodiment described above uses three CPUs 10 to 30, the number of the circuits which can be omitted increases and the effect of the invention becomes more remarkable when the present invention is applied to a trouble shooting apparatus serving a greater number of CPUs. The present invention can likewise be applied to various other data communication equipment besides the trouble shooting apparatus. When applied to a driving apparatus for driving a large number of actuators through CPUs individually connected to the actuators, for example, the present invention can allow only the CPU, which drives a desired actuator, to process a driving signal output by an output device. In this case, too, the present invention can simplify the circuit construction of the driving device. Furthermore, when a large number of CPUs exist, output data of the output device may be transferred to a plurality of CPUs and then from these CPUs to other CPUs.

As described above in detail, in the data communication equipment according to the present invention, the data output by the output device includes the designation code for designating a predetermined CPU, and each CPU processes only the data containing the designation code which designates itself.

Therefore, in the present invention, a desired data can be processed by a desired CPU by sequentially transferring the data output by the output device to the CPUs. In other words, it is not necessary to connect individually and electrically the CPUs with the output device, and the circuit construction necessary for the data transfer can thus be simplified.

We claim:

1. Data communication equipment for transferring data comprising:

three central processing units each having a communication path serially connected to others of said three central processing units to form a unidirectional serial communication loop between said three central processing units for transferring data, said data including a designation of a specific one of said three central processing units by which said data is to be processed, a first central processing unit of said three central processing units including a bidirectional communication path;

a memory provided for each of said three central processing units to store data transferred thereto;

a monitor device, connected to said bidirectional communication path of only said first central processing unit, for displaying diagnostic data indicating a trouble condition of any of a plurality of sensors connected to said three central processing units;

an output device provided in said monitor device for outputting request data to said first central processing unit to request data from said memory of said first central processing unit; and a mutual communication circuit, connected to said first central processing unit and said output device of said monitor device, for allowing bidirectional data communication between said monitor device and said first central processing unit, for temporarily storing said request data from said monitor device and said data requested from said memory of said first central processing unit, for outputting said temporarily stored data requested from said monitor device to said first central processing unit when said first central processing unit is ready to receive said data requested, and for outputting said temporarily stored data requested to said monitor device when said monitor device is ready to receive said data requested;

each respective one of said three central processing units processing data transferred thereto over said unidirectional serial communication loop if said data includes a designation code designating the respective one of said three central processing units, and each respective one of said three central processing units transferring without processing data to a next one of said three central processing units connected to said serial communication path, if said designation code designates another respective one of said three central processing units; and wherein each respective one of said three central processing units transfer response data indicating a trouble condition of respective ones of said plurality of sensors over said communication loop to said monitor device via said first central processing unit for display.

2. Data communication equipment for transferring data according to claim 1, wherein said three central processing units include:

said first central processing unit for controlling an ignition plug for igniting a plurality of cylinders;

a second central processing unit for controlling a fuel injection valve for injection of a fuel; and a third central processing unit for controlling an automatic transmission for automatically switching transmission gears;

said second central processing unit transferring data to said third central processing unit using direct memory access; and said third central processing unit transferring data to said first central processing unit.

3. Data communication equipment for transferring data according to claim 1, wherein said communication path of each of said three central processing units connected in said unidirectional serial communication loop each perform unidirectional communication only.

4. Data communication equipment for transferring data according to claim 1, wherein said data requested by said monitor device and output by said output device includes sequentially:

a header representing a start of said data requested;

a request CPU number designating any one of said three central processing units; and a request address designating a location of data regarding at least one of said plurality of sensors.

5. Data communication equipment for transferring data according to claim 4, wherein:

each respective one of said three central processing units generate response data corresponding to said plurality of sensors associated with said respective one of said three central processing units;

each respective one of said three central processing units judge whether or not said requested CPU number stored by said memory of said respective one of said three central processing units is said designation code of said respective one of said three central processing units, and when said judgement proves affirmative, judge when an abnormality in said plurality of sensors associated with said respective one of said three central processing units has occurred;

said respective one of said three central processing units judges whether or not said request address stored by said memory of said respective one of said three central processing units coincides with said address of said respective one of said three central processing units, and when said request address coincides, judges that said response data is correctly transferred;

when said response designation code stored by said memory of said respective one of said three central processing units corresponds to said designation code of said respective one of said three central processing units, said respective one of said three central processing units judge that said request data is not transferred correctly when said request address stored by said memory of said respective one of said three central processing units does not coincide with said address of said respective one of said three central processing units; and when said response designation code stored by said memory of said central processing unit is not said designation code of said respective one of said three central processing units, said respective one of said three central processing units does not affect said response data.

6. Data communication equipment for transferring data according to claim 1, wherein said response data includes sequentially:

a header representing a start of said diagnostic data;

a responding CPU number designation code for designating a responding one of said three central processing units which has detected said trouble condition of at least one of said plurality of sensors;

a response address designating a location of trouble data of said at least one of said plurality of sensors; and said trouble data.

7. Data communication equipment for transferring data according to claim 1, wherein:

said monitor device displays said diagnostic data indicating said trouble of said plurality of sensors when said responding CPU number designation code and said response address are judged by said first central processing unit as coinciding with a specific request CPU number and a specific request address output by said monitor device.

8. Data communication equipment for transferring data according to claim 1, wherein said first central processing unit judges whether or not said request data output by said output device designates said first central processing unit and, if said request data does not designate said first central processing unit, said first central processing unit transfers said data to said next one of said three central processing units connected to said unidirectional serial communication loop.

* * * * *